US005495515A

United States Patent [19]

Imasaki

[11] Patent Number: 5,495,515

[45] Date of Patent: Feb. 27, 1996

[54] METHOD AND APPARATUS FOR PRODUCING HIGH-INTENSITY X-RAYS OR γ-RAYS

[75] Inventor: Kazuo Imasaki, Osaka, Japan

[73] Assignee: Institute for Laser Technology, Osaka, Japan

[21] Appl. No.: 220,874

[22] Filed: Mar. 31, 1994

[30] Foreign Application Priority Data

Aug. 19, 1993 [JP] Japan ..... 5-205355
Mar. 18, 1994 [JP] Japan ..... 6-048641

[51] Int. Cl.[6] ..... H01J 35/14

[52] U.S. Cl. ..... 378/119; 378/121; 378/137

[58] Field of Search ..... 378/119, 121, 378/137

[56] References Cited

U.S. PATENT DOCUMENTS 3,822,410 7/1974 Madey ..... 378/119
4,598,415 7/1986 Luccio et al. ..... 378/119

*Primary Examiner*—Constantine Hannaher
*Assistant Examiner*—Don Wong
*Attorney, Agent, or Firm*—Wenderoth, Lind & Ponack

[57] ABSTRACT

A method and apparatus for producing high-intensity X-rays or γ-rays by accumulating a laser beam in an optical resonator having ultra-high reflectivity mirrors. With this arrangement, it is possible to produce powerful X-rays or γ-rays even if the laser beam used is not powerful enough. A laser beam from a laser is injected into an optical resonator and accumulated therein. The optical resonator has an opposed pair of mirrors having a reflectivity of more than 0.999%. An electron beam may be introduced obliquely into the optical resonator and collided against the laser beam. In the interaction area thus created, X-rays or γ-rays are produced due to the Compton scattering and propagated out of the optical resonator.

16 Claims, 5 Drawing Sheets

METHOD AND APPARATUS FOR PRODUCING HIGH-INTENSITY X-RAYS OR γ-RAYS

This invention relates to a method and apparatus for producing high-intensity X-rays or γ-rays by the interaction between photons and electrons.

BACKGROUND OF THE INVENTION

Electromagnetic waves having a wavelength shorter than ultraviolet rays, say, between 10 and 0.01 nm are generally called X-rays. Among them, those having a wavelength longer than about 0.3 nm are called soft X-rays while those having a wavelength shorter than 0.3 nm are called hard X-rays. Those having shorter wavelengths than X-rays are called γ-rays.

X-rays are ordinarily produced by bombarding accelerated electron beams against a metal. In order to produce X-rays by this principle, sealed X-ray tubes or rotary anode type X-ray tubes are used. To produce soft X-rays, an electron beam-excited soft X-ray source or a plasma soft X-ray source is used.

Such conventional X-ray sources were extremely low in X-ray generating efficiency. In fact, they can produce X-rays having a power of only several percent or less of the power exerted on the target with most of the power being converted into heat. Thus, a large amount energy is wasted. If laser beams are utilized to produce X-rays as with plasma soft X-ray sources, laser beams are wasted as heat. Thus, in order to increase the amount of produced X-ray, it is necessary to use powerful laser beams. Also, these X-ray sources tend to produce X-rays having a wide spectrum other than characteristic X-rays. This worsens the X-ray generating efficiency if it is necessary to produce X-rays with monochromatic spectrum of energy.

Now turning the subject to the field of astronomy dealing with gravitational waves, Einstein predicted in his famous general theory of relativity the existence of gravitational waves which are considered to be produced by explosion of supernovas. But as of today, such gravitational waves have not been observed directly, though trials have been made to develop antennas which can pick up such gravitational waves.

Gravitational wave antennas are designed to pick up "spatial distortion due to gravitational waves". The spatial distortion is extraordinarily low in level. In fact, the distortion level is so low that it is impossible to detect such distortion with ordinary industrial equipment. Such a distortion will be observed e.g. with a laser interferometer which will be formed by applying laser beams to a Michelson interferometer.

Such a laser interferometer uses an ultra-high-performance performance optical resonator provided in the optical path of laser beams so that it can detect ultra-small deflections. The optical resonator is a Fabry-Perot resonator having two oppositely arranged mirrors. The mirrors used are ones having a surprisingly high reflectivity. The higher the reflectivity of the mirrors used, the larger the amount of energy which the optical resonator can accumulate. When synchronized with light having a predetermined frequency, the resonator can accumulate a high-intensity light beam.

On the other hand, an X-ray generator utilizing the Compton backward scattering effect is disclosed in U.S. Pat. No. 4598415. It has a laser oscillator comprising two reflecting mirrors and a laser disposed between the mirrors.

Electrons accelerated by an accelerator are put in orbit and let collide with the laser beams that reciprocate between the reflecting mirrors. When they collide, X-rays having a narrow frequency band are produced due to the Compton scattering.

The X-rays and γ-rays emitted from this X-ray generator due to the Compton scattering are narrow in spectrum and monochromatic. Also the direction in which they are emitted is concentrated within the solid angle of forward $1/\gamma$ ($\gamma$ is the Lorentz factor of the electron beams).

On the other hand, with this method, the sectional area of collision between electrons and photons is extremely small, so that it is impossible to sufficiently increase the radiation dose. In order to solve this problem, it was proposed to generate X-rays in a resonator as in the above-identified U.S. Patent.

But since the output of the X-ray generator of the type disclosed in the U.S. Patent is determined by the saturation level of laser gain in the resonator, it is impossible to increase the output above a predetermined value no matter how high the reflectivity of the reflecting mirrors. Also, these media necessarily have a damage threshold of the laser media according to the laser intensity. Such a threshold also limits the internal power. For these reasons, the reflectivity of the resonator is at most 99–98%. Moreover, since only a resonator is used as a laser, its output is not so large. It is impossible to use a large-output laser utilizing an oscillating/amplifying system.

In spite of the fact that an optical resonator having a surprisingly high reflectivity of 99% or higher is available, conventional X-ray generators do not require an optical resonator having such a high reflectivity. Thus, even if such a high-performance resonator is used with a conventional X-ray generator to produce X-rays utilizing laser beams, it is impossible to produce high-intensity X-rays or γ-rays with high efficiency.

The inventors have found out that powerful X-rays or γ-rays can be obtained by accumulating laser beams in a photon accumulating cavity by means of ultra-high-reflectivity mirrors and bombarding electron beams against the laser beams.

But in order to produce high-power X-rays or γ-rays, it is necessary not only to improve the efficiency of interaction between the electron beams and the laser beams, but to properly set various other conditions such as the conditions of electron beams and laser beams introduced into the interaction area and the energy intensity of the laser beams.

SUMMARY OF THE INVENTION

It is an object of this invention to provide a method and apparatus for producing X-rays or γ-rays which can produce powerful X-rays or γ-rays with high efficiency.

According to this invention, there is provided a method of producing high-intensity X-rays or γrays, comprising the steps of introducing a laser beam into a photon accumulating cavity means having two mirrors having an ultra-high reflectivity and arranged opposite to each other to accumulate the laser beam in the cavity, and introducing an electron beam accelerated to a relativistic speed into the optical path of the laser beam reciprocating between the mirrors so as to cross the optical path, whereby X-rays or γ-rays are produced by the interaction between the electron beam and the laser beam.

From another aspect of the invention, there is provided an apparatus for generating high-intensity X-rays or γ-rays, comprising a laser generator for generating a laser beam, a photon accumulating cavity means for accumulating the laser beam therein, a pair of mirrors oppositely arranged and having an ultra-high reflectivity, an accelerator for accelerating an electron beam to a relativistic speed, and means for adjusting the distance between the reflecting mirrors. The cavity means has an inlet path for introducing the electron beam into the optical path of the laser beam reciprocating between the reflecting mirrors to smash the electron beam against the laser beam, and an outlet path for guiding the electron beam out of the cavity means together with X-rays or γ-rays produced by interaction between the electron beam and the laser beam.

Laser beams having a predetermined wavelength are accumulated in the photon accumulating cavity comprising ultra-high-reflectivity mirrors. When laser beams are accumulated in it, the laser beams reciprocating between the two mirrors form standing waves and are synchronized with the length of the resonator. For this purpose, it is necessary to adjust the length of the resonator with high accuracy on the order of less than λ/10 of the wavelength of the laser beam.

By the collision of the beam electrons accelerated to a relativistic speed against the accumulated laser beams, X-rays or γ-rays in the form of scattered light are obtained due to the Compton scattering resulting from the interaction between the electrons and photons.

The intensity $P_s$ of the scattered light is given by the following formula:

$$P_S \propto I_b \cdot P_L \quad (1)$$

where $P_L$ is the intensity of the laser beams, $I_b$ is the current of the electron beam in the case of the spontaneous emmision.

Thus, $P_s$ increases in direct proportion to the intensity of the laser beams.

On the other hand, the fineness F which represents the sharpness of selection of the wavelength of the laser beams accumulated in the optical resonator as the photon accumulating cavity is given by the following formula:

$$F=\pi\sqrt{R}(1-R) \quad (2)$$

where R is a reflectivity of the mirror. The power of the laser beams accumulated in the photon accumulating cavity is given by the following formula:

$$I_S=F \quad I_i \quad (3)$$

where $I_i$ is the power of the incident laser beam.

As will be apparent from the above, according to the method of the present invention, the intensity of the initially introduced laser beam is multiplied by the number equal to the value of the fineness. Thus, it is possible to equally multiply the intensity of the scattered light, i.e. X-rays or γ-rays. For example, if the mirrors have a reflectivity R of 0.99999% fineness F will be about $3\times10^5$, so that the accumulated laser power will be $3\times10^5$-fold of the incident laser power.

According to the present invention, since laser beams and electron beams interact with each other in the photon accumulating cavity, they have to be introduced under conditions suitable for interaction. Thus, it is preferable that if the laser beams are continuous light, the electron beams also be continuous and, if the laser beams are a pulse form, the electron beams also be introduced in a pulse form. If electron beams are continuous while laser beams are in a pulse form, or vice versa, energy will exist where there is no interaction. This lowers the efficiency of interaction.

The wavelength λ of X-rays or γ-rays thus obtained is roughly given by the following formula:

$$\lambda=\lambda_i/4\gamma^2 \quad (4)$$

where $\lambda_i$ is the wavelength of the incident laser beam and γ is the energy of the incident laser beam. If the wavelength $\lambda_i$ of the incident laser beam is 1 μm and the electrons have a voltage of 10 MeV, γ will be about 20, so that photons having a wavelength γ of 6 Å (angstrom) are obtainable.

The spread angle Δθ of the light thus produced is given by the formula:

$$\Delta\theta \propto \gamma^{-1} \quad (5)$$

If the parameters are as above, the spread angle will be 50 mrad. This figure represents an extremely small angle of dispersion of X-rays. X-rays or γ-rays having such a small angle of dispersion will undergo little increase in width even after traveling a rather long distance. Thus, they can be used e.g. to dispose of nuclear wastes.

In the method according to the present invention, the orbit of the electron beam is bent when the electron beam crosses the optical path of the laser beam so that the electron beam travels in parallel to the optical path for a predetermined distance. With this arrangement, it is possible to prolong the interaction area, so that higher-intensity X-rays or γ-rays can be produced.

In the method according to the present invention, an electron beam is injected in the photon accumulating cavity as a waveform, while a laser beam is introduced in continuous or semi-continuous form and modulated in the cavity for waveform shaping to put it into accord with the pulse waveform and timing of the electron beam. A laser beam having a pulse waveform is thus obtained.

With this arrangement, it is possible to improve the efficiency of interaction between the electron beam and the laser beam and thus to generate more powerful high-intensity X-rays or γ-rays. In generating X-rays or γ-rays by smashing an electron beam against a laser beam, not only the electron beam and laser beam are modulated to continuous or pulse waveforms, but the waveform of the laser beam is shaped so as to agree with the electron beam. This further improves the efficiency of interaction.

As shown in FIGS. 6A and 6B, by setting the pulse widths $\tau_b$ $(=1_1/v_b)$ and $\tau_1$ $(=1_1/c)$ of the electron beam E and laser beam L at substantially the same level when they collide with each other, it is possible to maximize the efficiency of interaction. The electron beam should be introduced so that it collides with the laser beam when the laser beam is converged at the focal point. If the timing is not right or the pulse widths do not coincide, only part of the laser beam will interact with the electron beam, thus worsening the efficiency of interaction. Thus, for high efficiency of interaction, it is essential that they match with each other.

If the laser beam has a continuous waveform, it can be introduced into the cavity with higher efficiency. If the fineness in the cavity is high, the band width (Δ) of the incident beam is limited to $\Delta\propto(F^{1/2})^{-1}$. This is because continuous light can be more easily formed into a narrow band width.

Also, by modulating the laser beam in the cavity in various ways, it is possible to use various kinds of accelerators for accelerating electron beams. This leads to increased technical diversification.

For example, if the laser beam is continuous, the electron beam also has to be introduced in continuous form. This arrangement is suited for interaction with a continuous electron beam produced in an electrostatic accelerator. In an arrangement in which an electron beam having a pulse waveform is accelerated with a storage ring, it is possible to optimize the interaction by modulating a continuous laser beam, matching the pulse duration by modulation of the laser beam with the electron beam in the storage ring, and compressing the pulse widths to substantially the same degree.

When generating X-rays or γ-rays by this method, the interaction area where the electron beam collides with the laser beam in the cavity should be provided near the convergent focal points of the ultra-high-reflectivity mirrors in the photon accumulating cavity. This is because the laser beam is converged to a minimum diameter near the convergent focal point and thus the energy intensity is the highest at these points.

The ultra-high-reflectivity mirrors provided in the photon accumulating cavity are preferably both concave mirrors. But only one of them may be a concave mirror with the other being a plane mirror. In either case, a convergent focal point is formed. In order to confine a laser beam in the cavity, the following relation has to be met:

$$0<(1-L/R_1)(1-L/R_2)<1$$

where $R_1$, $R_2$ are radii of curvature of the mirrors on the incident side and on the opposite side and L is the length of the resonator. If one of them is a plane mirror, $R_1-\infty$.

If both the mirrors are plane mirrors, the above formula will be equal to 1, so that it is impossible to confine a laser beam stably. By using a plane mirror and a concave mirror or a pair of concave mirrors, the above formula can be satisfied if the value R is determined properly. Thus, it is possible to provide a convergent focal point on the axis of the mirrors.

But in an arrangement where a plane mirror is used in combination with a concave mirror, the diameter of the laser beam will be minimum on the surface of the plane mirror. The laser beam extends substantially parallel up to the convergent focal point of the concave mirror on the other side but its diameter increases slightly.

In contrast, in the arrangement where two concave mirrors are used, the diameter of the laser beam will be minimum and thus its energy density will be maximum near the center between the convergent focal points of both mirrors. Thus, an electron beam should collide against a laser beam in this area.

In any of the arrangements, powerful X-rays or γ-rays are produced due to the interaction between an extremely strong laser beam and electron beam. The electron beam is cooled and accelerated as a reaction to the generation of X-rays or γ-rays. This is because the electron beam loses its energy ($\gamma_0 \rightarrow \gamma$) and accordingly, the energy dispersion and angular spread decrease.

From another aspect of the present invention, there is provided an apparatus for generating X-rays or γ-rays. It has a laser generator, a photon accumulating cavity and an accelerator. An electron beam collides against a laser beam in the photon accumulating cavity to generate X-rays or γ-rays. With this apparatus, it is possible to accumulate a laser beam in the photon accumulating cavity by adjusting the length of the resonator with an adjusting means.

The X-rays or γ-rays thus produced propagate in such a direction as to form a predetermined angle with respect to the electron beam, which has been cooled and accelerated due to reaction to the generation of X-rays or γ-rays. Both of them are emitted outwards through the outlet path.

The reflecting mirrors in the photon accumulating cavity should have a reflectivity R=99.9% or higher. Thus, the X-rays or γ-rays are powerful enough to compare with those produced in conventional apparatus.

A magnetic field creating means should be provided in the photon accumulating cavity to bend the orbit of an electron beam. The electron beam propagates along the optical path of the laser beam reciprocating in the cavity and encounters the laser beam in the interaction area, thereby producing powerful X-rays or γ-rays.

A reflecting/transmissive mirror may be provided together with the high-frequency optical modulator. With this arrangement, it is possible to optimize the pulse distance and pulse width of the laser beam simply by changing the length of resonance of the laser beam and thus to produce still more powerful X-rays or γ-rays.

According to this invention, laser beams are introduced into the photon accumulating cavity having ultra-high-reflectivity mirrors and are accumulated therein. Powerful X-ray scattered light is produced due to the interaction between electron beams and the accumulated laser beam having a large light energy when they collide with each other. Even if the laser used is small, it is possible to produce extraordinarily powerful monochromatic X-rays or γ-rays when compared with conventional arrangements. Thus, high-intensity X-rays or γ-rays can be produced with a smaller laser and a smaller accelerator at lower cost. Such X-rays can be used for X-ray lithography or to activity annihilation of disposed nuclear wastes.

BRIEF DESCRIPTION OF THE DRAWINGS

Other features and objects of the present invention will become apparent from the following description made with reference to the accompanying drawings, in which.

DETAILED DESCRIPTION OF THE INVENTION

Figure 1:
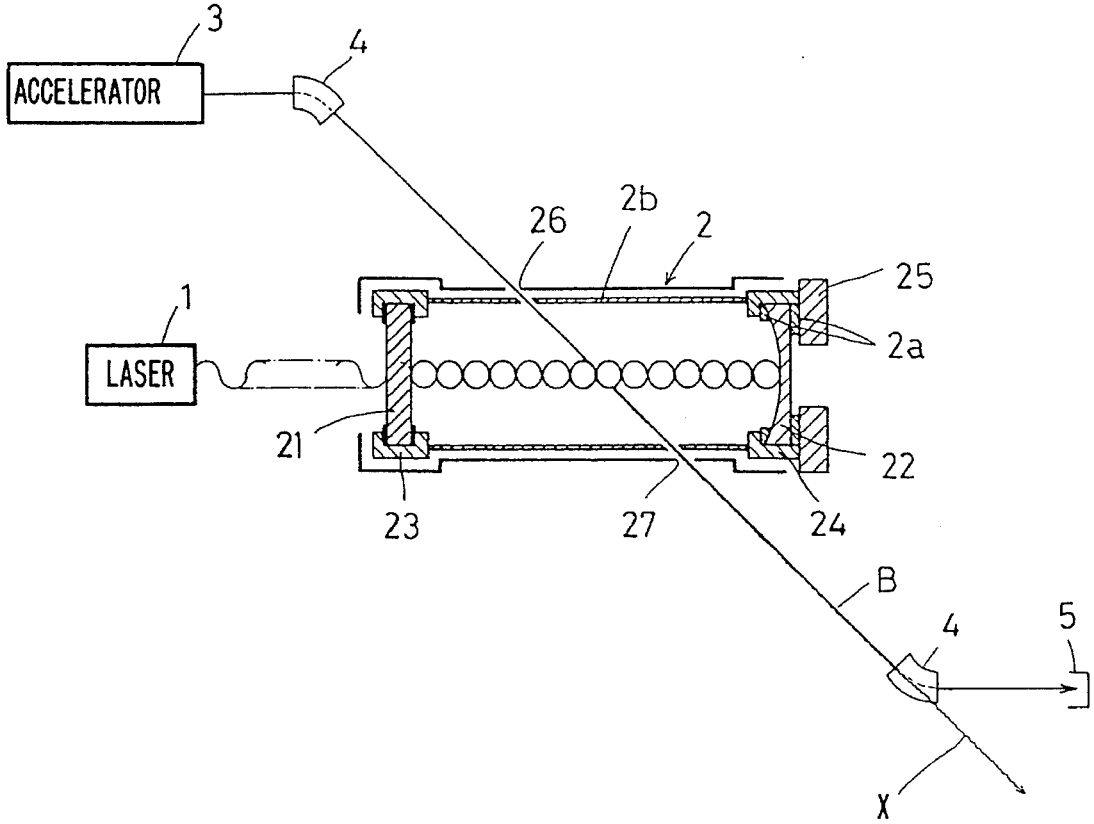
FIG. 1 is a schematic diagram of the X-ray or γ-ray generator of one embodiment.

Now referring to the drawings, we shall describe the embodiments of this invention.

FIG. 1 schematically shows the X-ray or γ-ray generator of the first embodiment. It comprises a laser 1, an optical resonator (or photon accumulating cavity) 2 and an electron beam accelerator 3. The laser 1 may be of any type, such as a semiconductor laser, a fixed laser, a gas laser or a free electron laser.

The electron beams emitted from the accelerator 3 are bent by a polarizing electromagnet 4, passed through the optical resonator 2, bent again by another polarizing electromagnet 4, and treated in a beam damper 5. The cavity in the optical resonator 2 and the path for electron beams are kept under vacuum. For simplicity, the duct forming the path of electron beams is not shown.

The optical resonator 2 has two mirrors having an ultra-high reflectivity and opposed to each other. One mirror 21 may have a flat reflecting surface while the other mirror 22 may have a concave reflecting surface of a predetermined curvature. Each reflecting surface may be formed by vapor-depositing, by ion beam sputtering, a coating of an ultra-low-loss dielectric film on an ultra-high-accuracy substrate under ultra-high vacuum. The coating may be $Ta_2O_5/SiO_2$.

The mirrors 21 and 22 are mounted in a sealed state by means of holders 23 and 24, respectively. The mirror 21 is fixed. To the mirror 22, a piezoelectric element (PZT) 25 may be used or connected through a seal member 2*a* made of Teflon. By applying a voltage to the piezoelectric element 25, the mirror 22 is moved to adjust the length of the resonator.

The cavity of the optical resonator 2 is formed with upper and lower obliquely-arranged small holes 26 and 27 through which electron beams B pass.

This device can generate X-rays or γ-rays X in the following manner. A laser beam having a predetermined wavelength is emitted by the laser 1 toward the optical resonator 2. For example, a laser beam having a wavelength γ of 850 nm is emitted toward the optical resonator 2 from the lower source 1 located outside the optical resonator, with the distance between the mirrors 21 and 22 set at 4 mm. The mirror 22 may have a radius of curvature of 173 mm and a surface sphericity of γ/10 and have a surface finished to a roughness of about 0.1 nm. The mirror 21 should have a completely flat surface finished to substantially the same degree of surface roughness as the mirror 22.

Such an optical resonator 2 can attain a reflectivity $R=1-L=0.9999984$. Its fineness F was $F=\pi\sqrt{R}/(1-R)$ and thus $F=2\times10^6$.

In the optical resonator 2, the laser beam reciprocates between the two mirrors 21, 22, so that the progressive waves of the beam interfere with each other, producing standing waves. Such standing waves cannot be produced unless the distance between the mirrors 21 and 22 is adjusted to a predetermined length with extremely high accuracy. Thus, in the embodiment, the distance between the mirrors is adjusted with the accuracy of λ/10 or more by applying a predetermined voltage to the piezoelectric element 25.

The electron beam emitted from the accelerator 3 is injected into the optical resonator 2 and collided against the laser beam. X-rays or γ-rays X are thus produced from the area where the electron beam and the laser beam interact.

Figure 2:
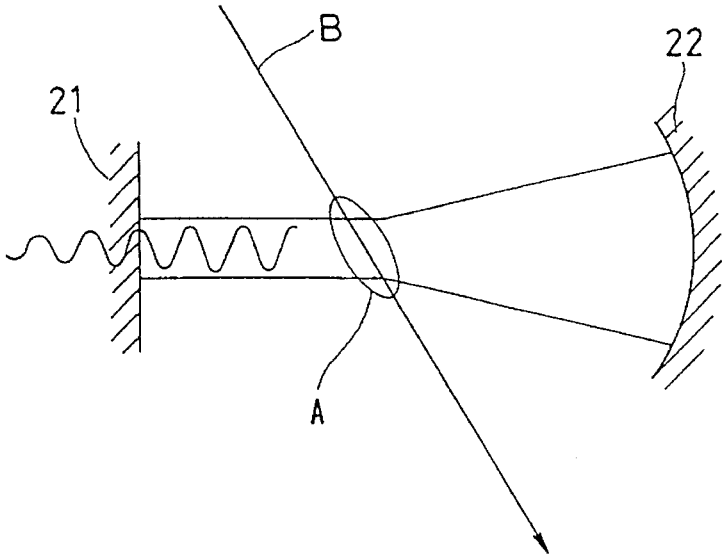
FIG. 2 is a view showing how to generator of FIG. 1.

In this embodiment, since the reflecting mirror 21 is a plane mirror while the other mirror 22 is a concave mirror, the diameter of the laser beam will be minimum on the plane mirror. But, as shown in FIG. 2, its diameter increases little for some distance therefrom and begins to increase near the focal point of the concave mirror 22. Thus, it is possible to produce X-rays or γ-rays with the highest efficiency if the electron beam is interacted with the laser beam at a point slightly before the diameter of the laser beam begins to increase. The electron beam should preferably be converged to a diameter of 1 mm or less and bombarded against a correspondingly converged laser beam.

Since the X-rays or γ-rays thus produced have an intensity proportional to the fineness of the optical resonator, it is possible to obtain powerful X-rays or γ-rays proportional to the energy of the optical resonator and having an intensity of about $10^6$ even if the laser beam emitted from the laser 1 is weak. Such X-rays or γ-rays are produced so as to form a certain angle with respect to the direction of the electron beams B. Thus, they can be used for e.g. X-ray lithography by guiding them in a suitable direction with another mirror (not shown).

In the embodiment, the reflectivity R was 0.9999984. But if R is 0.999 or higher, the X-rays obtained will be sufficiently powerful compared with those obtained by conventional X-ray generators. Such X-rays can be used for a variety of applications.

Figure 3A:
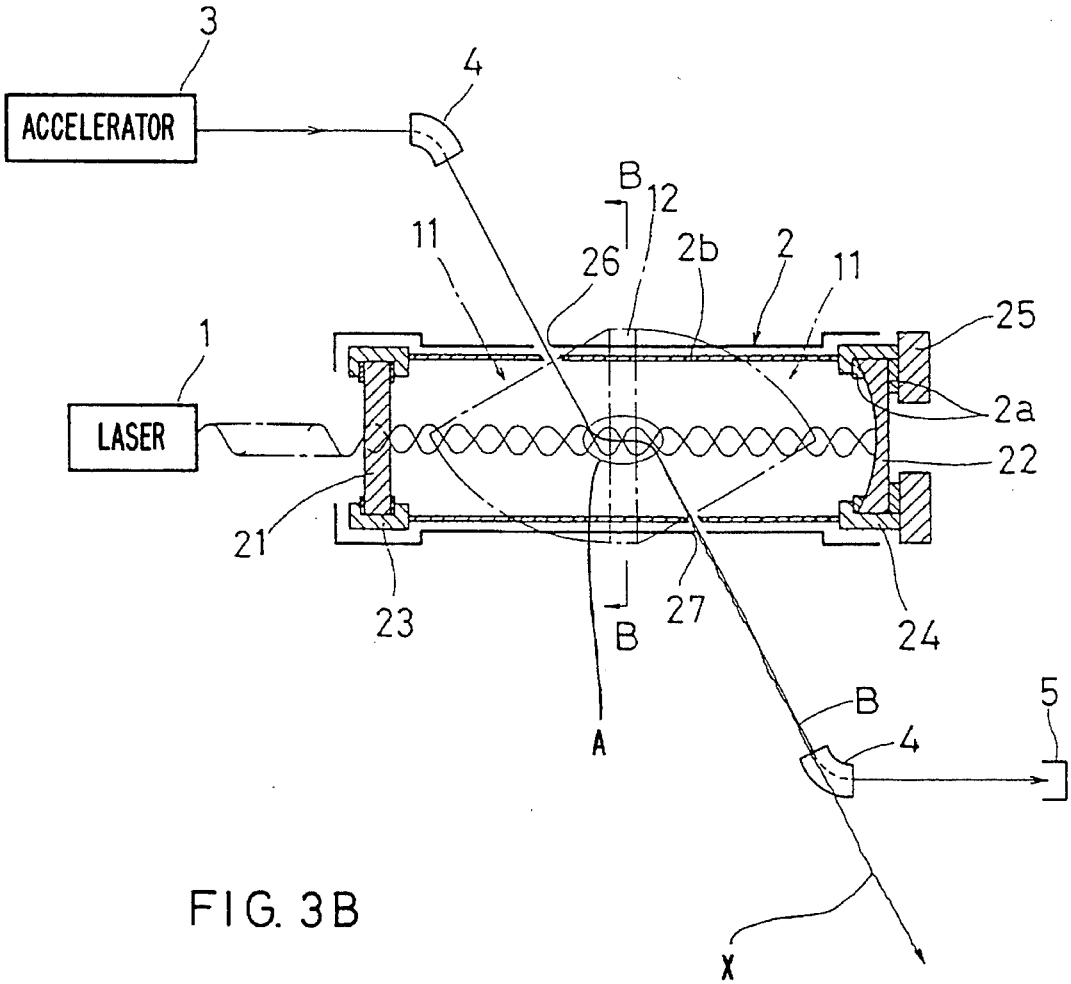
FIG. 3A is a schematic diagram of another embodiment.
Figure 3B:
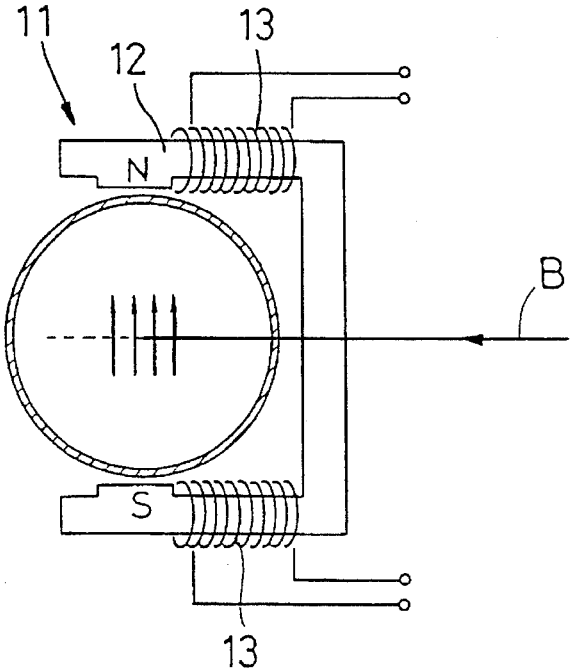
FIG. 3B is a view showing a deflecting electromagnet.

FIG. 3A shows another embodiment in which a pair of polarizing electromagnets 11 as a magnetic field creating means are provided outside the photon accumulating cavity 2 shown in FIG. 1. As shown in FIG. 3B, polarizing electromagnets 11 each comprise an iron core 12 and a coil 13 wound therearound and adapted to create a magnetic field that extends in a direction perpendicular to the moving direction of an electron beam. Thus, the electron beam is bent laterally by the magnets 11.

The electron beam thus bent travels a predetermined distance along the optical path of the laser beam reciprocating in the photon accumulating cavity 2. The electron beam is then bent again by another pair of polarizing electromagnets 11 and guided out of the photon accumulating cavity 2. The area where the electron beam travels the predetermined distance along the optical path of the laser beam corresponds to the interaction area A where the electron beam impinges on the laser beam so that powerful X-rays or γ-rays X are generated.

Figure 4:
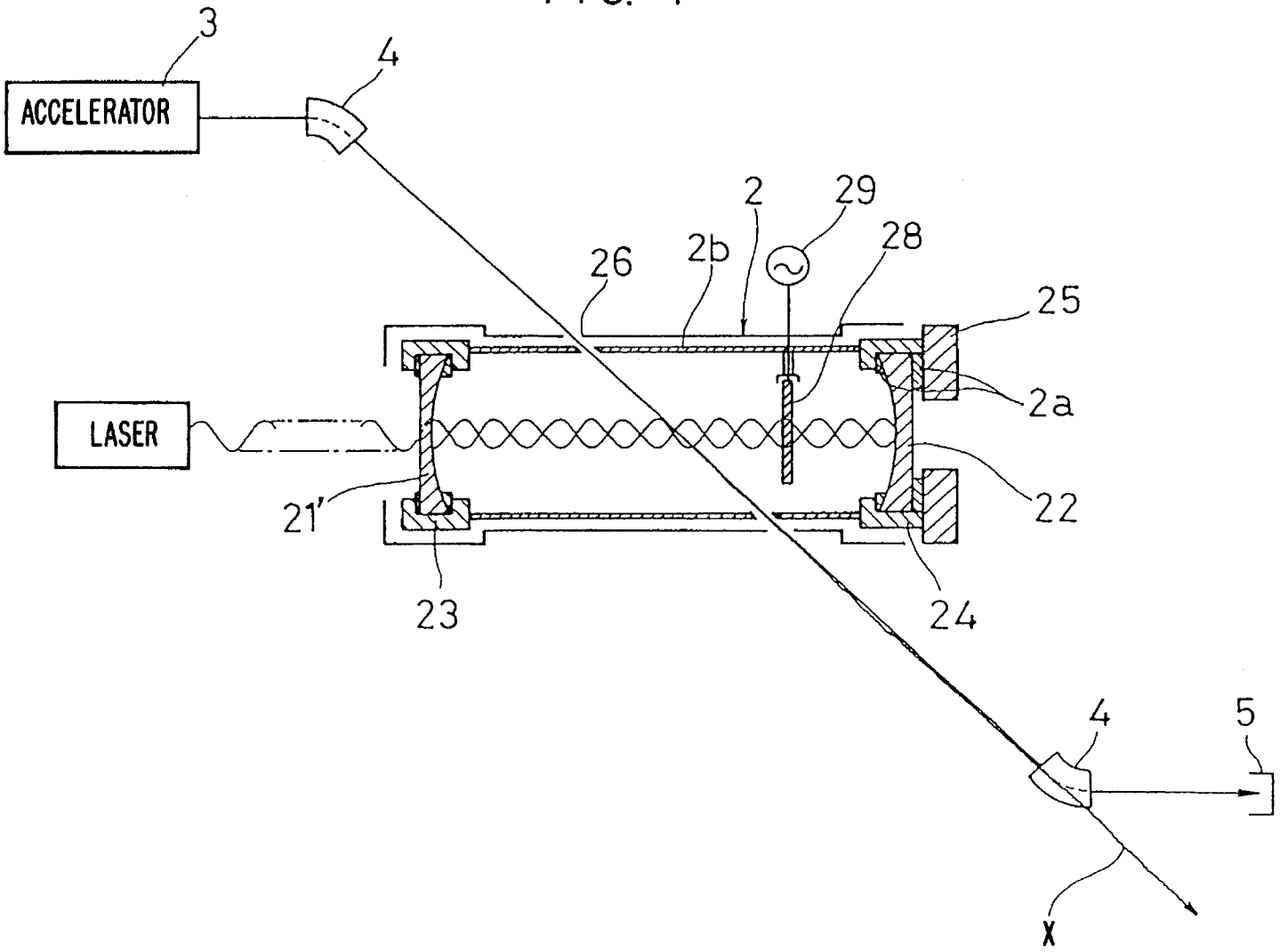
FIG. 4 is a schematic diagram of another embodiment.

FIG. 4 shows an entire schematic diagram of the third embodiment. The same members as in the first embodiment are represented by the same numerals and their description is omitted. This embodiment differs from the first embodiment in that the reflecting mirrors 21', 22 provided on both sides of the optical resonator 2 are both concave mirrors and that there are provided an optical modulator 28 and its high-frequency power source 29.

In this embodiment, we use the concave reflecting mirror 21' to provide the minimum convergent point of the laser beam near the convergent focal points of the reflecting mirrors 21', 22. With this arrangement, it is possible to increase the power density of the laser beam at the interaction area because it is converged to such an extent that its spot beam diameter decreases Will be minimum.

In this embodiment, the convergent focal points of the reflecting mirrors on both sides are spaced apart a predetermined distance from each other. But the mirrors may be arranged such that the convergent focal point of one mirror exists in the area of the other mirror so as to cross with each other or their convergent focal points coincide on a single point. In any case, the minimum convergent point is formed near the convergent focal points.

As is well-known in the art, the optical modulator 28 may be an electro-optical one or an acoustic-optical one (or may be of any other type). An electro-optical modulator has a Pockels element and is designed to modulate phase and frequency utilizing its electro-optical effects. An acoustic-optical modulator is used to change refraction factors according to ultrasonic waves. Both devices operate under a high-frequency voltage applied from a high-frequency power source. Such a high-frequency power source may be a variable-frequency type.

The optical modulator 28 should preferably be mounted near one of the reflecting mirrors 21' and 22 but may be mounted anywhere between the mirrors except the interaction area.

In this embodiment, the electron beam and laser beam are of different kinds. Namely, in the first embodiment, both the electron beam and the laser beam are continuous waves (CW) or both of them are pulse-waves. In this embodiment, the electron beam is pulse form while the laser beam from the laser 1 is in the form of continuous or semi-continuous waves but modulated to pulse form by the optical modulator 28 in the optical resonator 2.

By the term "semi-continuous", we mean nearly continuous ultra-high-repeated pulse waves.

In this embodiment, the efficiency of interaction between the electron beam and the laser beam improves still further, so that it is possible to produce still more powerful X-rays or γ-rays.

The laser beam emitted from the laser 1 is in the form of continuous waves (CW) or semi-continuous waves but is modulated to pulse laser beams having a phase or frequency determined by the optical modulator 28 when it passes through the optical modulator 28. It is then accumulated in the resonator by reciprocating between the reflecting mirrors 21' and 22.

By colliding the electron beam against the laser beam in the interaction area, X-rays or γ-rays X are produced due to the interaction therebetween. The electron beam is introduced in the form of pulse waves. Thus, the pulse distance and pulse width of the pulse laser beam have to be modulated according to the pulse distance and pulse width of the electron beam. In this way, it is possible to improve the efficiency of interaction therebetween and thus to produce still more powerful X-rays or γ-rays. The X-rays or γ-rays produced are of course pulse forms.

In the same manner as the laser beam is converged so that its diameter is minimum near the convergent focal point, it is preferable that the electron beam introduced into the optical resonator 2 be converged so that its diameter will be minimum in the interaction area. For this purpose, though not shown, the electron beam may be converged to a predetermined diameter with an electromagnetic lens having an electromagnet before introducing it into the optical resonator 2.

Figure 5A:
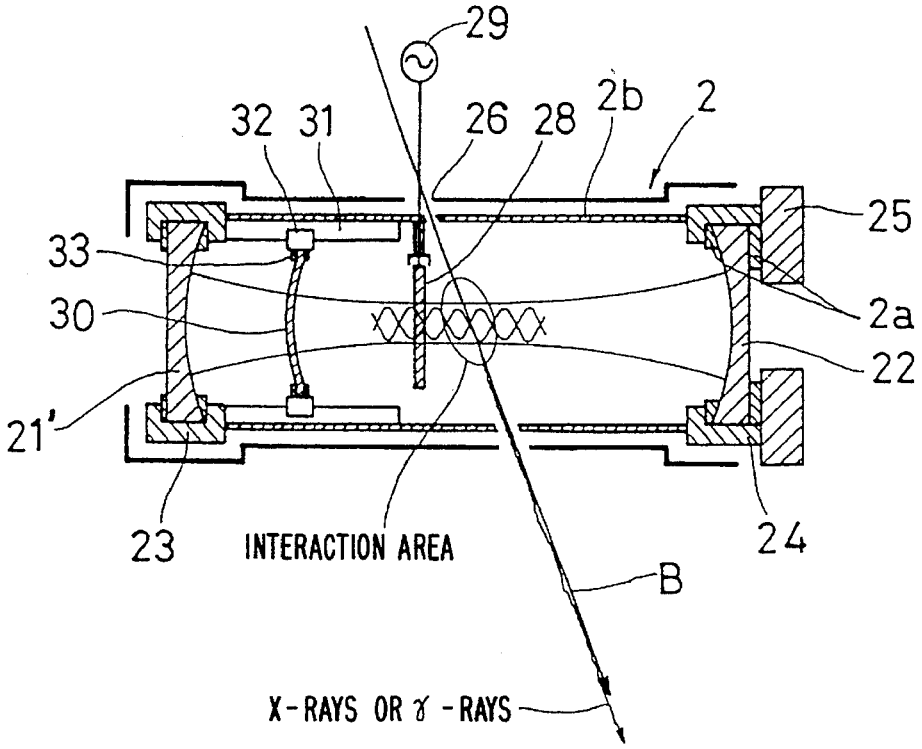
FIGS. 5A and 5B are schematic diagrams of still other embodiments.
Figure 5B:
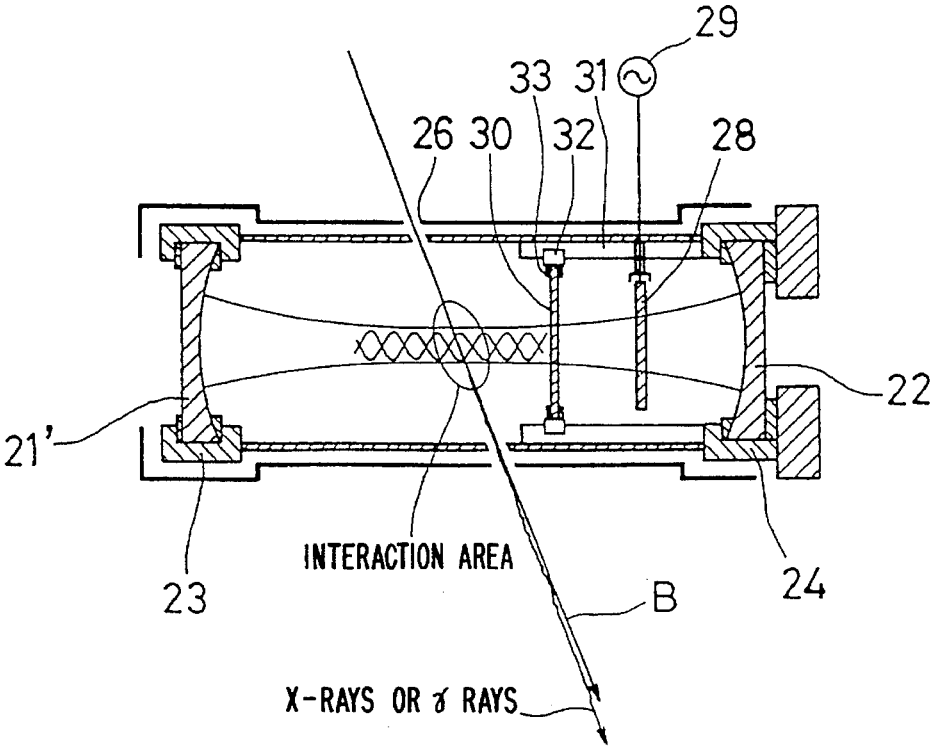
Figure 6A:
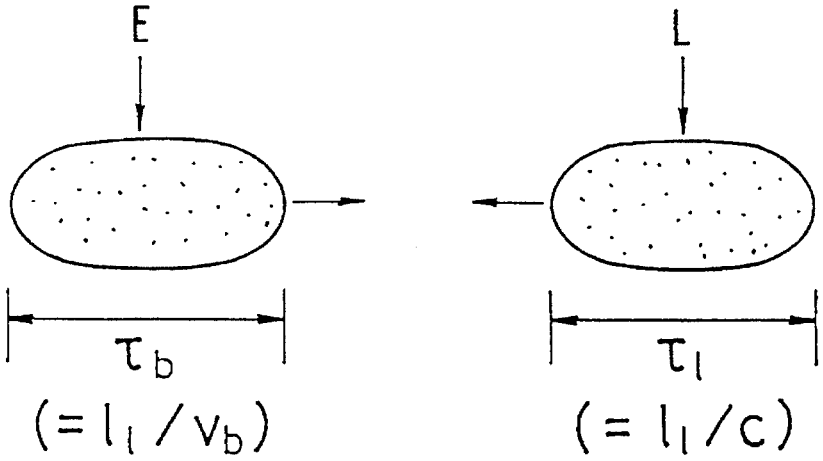
FIGS. 6A and 6B are views showing the interaction between electron beams and laser beams.
Figure 6B:
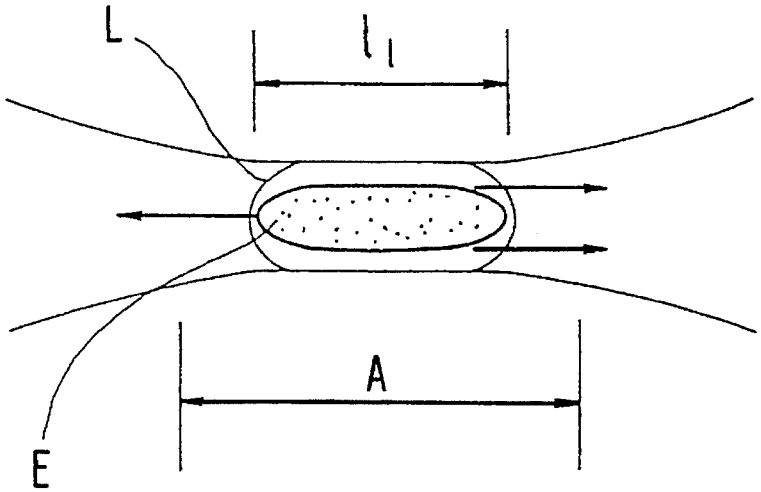

FIGS. 5A and 5B shows the fourth embodiment. For simplicity, only the optical resonator 2 is shown because the other members are the same as those in the embodiment of FIG. 4. The same members as in the embodiment of FIG. 4 are represented by the same numerals and their description is omitted.

In this embodiment, the optical resonator 2 of FIG. 4 is further provided with a reflecting/transmissive mirror 30. This mirror 30 is a reflecting mirror having a reflectivity of 90% and a transmittance of 10%. This reflecting/transmissive mirror 30 may be either a plane mirror or concave mirror.

From FIGS. 5A and 5B, it will be apparent that the reflecting/transmissive mirror 30 may be provided anywhere in the optical resonator 2 except the interaction area.

By providing the reflecting/transmissive mirror 30, the length of the resonator changes for the laser beam reflected by this mirror. Thus, when setting its position to adjust the pulse beam obtained by modulating the laser beam introduced into the optical resonator 2 with the optical modulator 28 to the pulse width and pulse distance of the electron beam in pulse form, the reflecting/transmissive mirror 30 should preferably be mounted through a seal member 33 made of Teflon to a guide 32 movable on a guide base 31 mounted inside so that its position is finely adjustable with a piezoelectric element (PZT) 34 mounted on the guide 32. The guide 32 is movable from outside with a screw or a motor.

In this embodiment, since the optical modulator 28 is used as in the embodiment of FIG. 4, its function is the same. But by the provision of the reflecting/transmissive mirror 30, it is possible to optimize the pulse width and pulse distance of the laser beam and thus to improve the efficiency of interaction between the electron beam and the laser beam.

What is claimed is:

1. A method of producing high-intensity X-rays or γ-rays, comprising the steps of introducing a laser beam into a photon accumulating cavity from a laser source located outside said cavity, wherein said cavity has two mirrors having an ultra-high reflectivity and being arranged opposite to each other to accumulate the laser beam in said cavity, and introducing an electron beam accelerated to a relativistic speed into the optical path of the laser beam reciprocating between said mirrors so as to cross said optical path, thereby producing X-rays or γ-rays from the interaction area between the electron beam and the laser beam.

2. A method of producing high-intensity X-rays or γ-rays as claimed in claim 1, wherein when the electron beam crosses the optical path of the laser beam, the orbit of the electron beam is bent so that the electron beam travels in parallel to said optical path for a predetermined distance, said interaction area being the area where the electron beam travels in parallel to the optical path of the laser beam.

3. A method of producing high-intensity X-rays or γ-rays as claimed in claim 2, wherein the laser beam introduced into said photon accumulating cavity is continuous or semi-continuous, wherein the laser beam is modulated in said cavity to shape its waveforms into accord with the electron beam in pulse waveform, timing and temporal waveform and wherein the electron beam is smashed against the laser beam in the area near the convergent focal points of said mirrors.

4. A method of producing high-intensity X-rays or γ-rays as claimed in claim 1, wherein the laser beam introduced into said photon accumulating cavity is continuous or semi-continuous, wherein the laser beam is modulated in said cavity to shape its waveforms into accord with the electron beam in pulse waveform, timing and temporal waveform and wherein the electron beam is smashed against the laser beam in the area near the convergent focal points of said mirrors.

5. An apparatus for generating high-intensity X-rays or γ-rays, comprising a laser generator for generating a laser beam, a photon accumulating cavity means for accumulating the laser beam therein, a pair of mirrors oppositely arranged and having an ultra-high reflectivity, an accelerator for accelerating an electron beam to a relativistic speed, and means for adjusting the distance between said reflecting mirrors, said cavity means having an inlet path for introducing the electron beam into the optical path of the laser beam reciprocating between said reflecting mirrors to smash the electron beam against the laser beam, and an outlet path for guiding the electron beam out of said cavity means together with X-rays or γ-rays produced by interaction between the electron beam and the laser beam.

6. An apparatus for generating high-intensity X-rays or γ-rays as claimed in claim 5, wherein said mirrors are formed of multilayered films made from a dielectric material and have a reflectivity of 99.9% or higher.

7. An apparatus for generating high-intensity X-rays or γ-rays as claimed in claim 6, further comprising a magnetic field creating means for bending the orbit of the electron beam introduced into said cavity means to create an interaction area in which the electron beam travels parallel to the optical path of the laser beam for a predetermined distance.

8. An apparatus for generating high-intensity X-rays or γ-rays as claimed in claim 7, wherein at least one of said two mirrors provided in said cavity means is a concave mirror having a convergent focal point in said cavity means, wherein said outlet path is provided so that said interaction area between the laser beam and the electron beam will be located near the convergent focal point, wherein the apparatus further comprises an optical modulator provided in an area other than said interaction area for modulating a continuous or semi-continuous laser beam introduced into said cavity means to shape its waveform into accord with the electron beam in pulse waveform and timing.

9. An apparatus for generating high-intensity X-rays or γ-rays as claimed in claim 8, further comprising a reflecting/transmissive mirror provided in said cavity means in an area other than said interaction area.

10. An apparatus for generating high-intensity X-rays or γ-rays as claimed in claim 6, wherein at least one of said two mirrors provided in said cavity means is a concave mirror having a convergent focal point in said cavity means, wherein said outlet path is provided so that said interaction area between the laser beam and the electron beam will be located near the convergent focal point, wherein the apparatus further comprises an optical modulator provided in an area other than said interaction area for modulating a continuous or semi-continuous laser beam introduced into said cavity means to shape its waveform into accord with the electron beam in pulse waveform and timing.

11. An apparatus for generating high-intensity X-rays or γ-rays as claimed in claim 10, further comprising a reflecting/transmissive mirror provided in said cavity means in an area other than said interaction area.

12. An apparatus for generating high-intensity X-rays or γ-rays as claimed in claim 5, further comprising a magnetic field creating means for bending the orbit of the electron beam introduced into said cavity means to create an interaction area in which the electron beam travels parallel to the optical path of the laser beam for a predetermined distance.

13. An apparatus for generating high-intensity X-rays or γ-rays as claimed in claim 12, wherein at least one of said two mirrors provided in said cavity means is a concave mirror having a convergent focal point in said cavity means, wherein said outlet path is provided so that said interaction area between the laser beam and the electron beam will be located near the convergent focal point, wherein the apparatus further comprises an optical modulator provided in an area other than said interaction area for modulating a continuous or semi-continuous laser beam introduced into said cavity means to shape its waveform into accord with the electron beam in pulse waveform and timing.

14. An apparatus for generating high-intensity X-rays or γ-rays as claimed in claim 13, further comprising a reflecting/transmissive mirror provided in said cavity means in an area other than said interaction area.

15. An apparatus for generating high-intensity X-rays or γ-rays as claimed in claim 5, wherein at least one of said two mirrors provided in said cavity means is a concave mirror having a convergent focal point in said cavity means, wherein said outlet path is provided so that said interaction area between the laser beam and the electron beam will be located near the convergent focal point, wherein the apparatus further comprises an optical modulator provided in an area other than said interaction area for modulating a continuous or semi-continuous laser beam introduced into said cavity means to shape its waveform into accord with the electron beam in pulse waveform and timing.

16. An apparatus for generating high-intensity X-rays or γ-rays as claimed in claim 15, further comprising a reflecting/transmissive mirror provided in said cavity means in an area other than said interaction area.

* * * * *